US006664892B2

(12) United States Patent
Thomas et al.

(10) Patent No.: US 6,664,892 B2
(45) Date of Patent: Dec. 16, 2003

(54) DEVICE INVENTORY BY SOUND

(75) Inventors: Andrew Thomas, Atherton, CA (US); Stephen John Hinde, Bristol (GB); Paul St John Brittan, Claverham (GB)

(73) Assignee: Hewlett-Packard Development Company, L.C., Palo Alto, CA (US)

( * ) Notice: Subject to any disclaimer, the term of this patent is extended or adjusted under 35 U.S.C. 154(b) by 0 days.

(21) Appl. No.: 09/994,933

(22) Filed: Nov. 28, 2001

(65) Prior Publication Data

US 2002/0067837 A1 Jun. 6, 2002

(30) Foreign Application Priority Data

Dec. 1, 2000 (GB) ..... 0029293

(51) Int. Cl.[7] ..... G08B 26/00

(52) U.S. Cl. ..... 340/505; 340/506; 340/692; 340/384.73; 340/5.92; 340/825.36; 340/10.4

(58) Field of Search ..... 340/505, 506, 340/5.1, 5.92, 825.36, 10.1, 10.4, 384.1, 384.4, 384.5, 384.6, 384.7, 384.71, 384.73, 692, 3.41; 367/95, 116; 235/385

(56) References Cited

U.S. PATENT DOCUMENTS 4,551,710 A 11/1985 Troup et al. ..... 340/505
5,155,469 A 10/1992 Hartmann et al. ..... 340/539.1
5,493,618 A * 2/1996 Stevens et al. ..... 381/110
5,677,675 A * 10/1997 Taylor et al. ..... 340/568.1
5,926,090 A * 7/1999 Taylor et al. ..... 340/568.1
6,097,288 A * 8/2000 Koeppe, Jr. ..... 340/517
6,246,322 B1 * 6/2001 LeDain et al. ..... 340/531

FOREIGN PATENT DOCUMENTS

GB 2313980 A 12/1997
WO 99/30302 6/1999

OTHER PUBLICATIONS

Information Technology—Local and Metropolitan Area Networks—; Part 3: Carrier sense multiple access with collision detection (CSMA/CD) access method and physical layer specifications; (American National Standard); 1993 Edition: published by: The Institute of Electrical and Electronics Engineers, Inc.

* cited by examiner

*Primary Examiner*—Toan N Pham

(57) ABSTRACT

When a person first enters an unfamiliar work space, it is useful for that person to know what devices are present in the space and often the person will spend the first few minutes looking around, effectively carrying out an inventory of the devices present. In order to simplify this process the devices are arranged to announce their existence by sound in response to a prompt, such as a handclap. To avoid the announcements being made all at once in an unintelligible manner, the devices interact with each other to order their announcements so that each device announcement is, at least in due course, made uninterrupted by announcements from other devices. Typically, this interaction involves the devices using a collision-detection and back-off protocol applied to the announcements themselves.

29 Claims, 1 Drawing Sheet

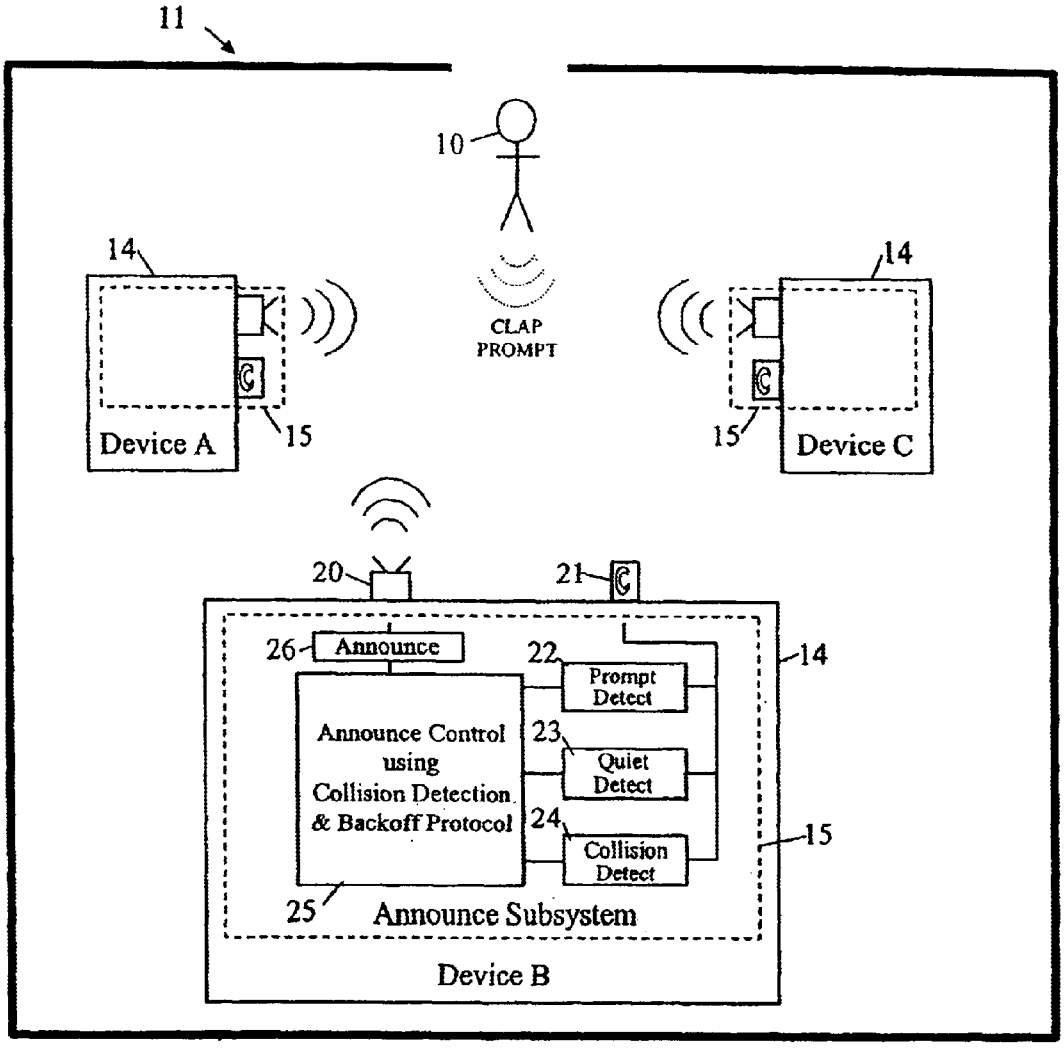
11
10
CLAP
PROMPT
14
Device A
15
14
Device C
15
20
21
26
Announce
22
Prompt
Detect
14
Announce Control
using
Collision Detection
& Backoff Protocol
23
Quiet
Detect
24
Collision
Detect
15
25
Announce Subsystem
Device B

DEVICE INVENTORY BY SOUND

FIELD OF THE INVENTION

The present invention relates to effecting an inventory of local devices by sound.

BACKGROUND OF THE INVENTION

When a person first enters an unfamiliar work space, it is useful for that person to know what devices are present in the space and often the person will spend the first few minutes looking around, effectively carrying out an inventory of the devices present.

It is an object of the present invention to provide a user-friendly way of ascertaining what devices are present locally.

As will become clear below, certain embodiments of the present invention use a collision-detection and back-off protocol. Such protocols are themselves well known in the networking art; thus the access control protocol used by Ethernet and IEEE 802.3 networks is one such protocol, it being normally termed a CSMA/CD ("Carrier Sense Multiple Access/Collision Detection") protocol. In such a network protocol, a device wishing to transmit on the network first listens to see if any other device is transmitting (this is the "carrier sense")—if no other device is currently transmitting, the device commences to transmit. However, since two devices may do this at substantially the same time, a transmitting device listens out for collisions of its transmissions with those of another device. Where such a collision is detected, the device stops transmission and backs off (that is, does not consider re-transmitting) for a randomly chosen time period. In Ethernet networks, this time period is chosen according to a binary exponential backoff policy.

SUMMARY OF THE INVENTION

According to one aspect of the present invention, there is provided a method of effecting an inventory of local devices, involving:

(a) issuing a prompt to the devices;

(b) at each device, responding to the prompt by announcing the presence of the device by sound;

(c) the devices interacting to order their announcements so that each device announcement is, at least in due course, made uninterrupted by announcements from other devices.

Step (c) will typically involve the devices using a collision-detection and back-off protocol in respect of emissions from each other. These emissions are preferably the sound announcements themselves though other device emissions can alternatively be used for running the protocol.

According to another aspect of the present invention, there is provided a device provided with an announcement arrangement comprising prompt detection means for detecting a broadcast prompt;

audio output means for announcing the presence of the device by sound; and announcement control means for interacting with nearby devices having similar announcement arrangements such that, at least in due course, each device makes its announcement, through its audio output means, uninterrupted by announcements from other of the said devices.

BRIEF DESCRIPTION OF THE DRAWINGS

A method and device embodying the invention, for effecting device inventory by sound, will now be described, by way of non-limiting example, with reference to the accompanying diagrammatic drawing, the sole FIGURE of which depicts a room with multiple self-announcing devices.

BEST MODE OF CARRYING OUT THE INVENTION

The FIGURE includes a work space 11 into which a user 10 has just entered. The user wishes to know what devices are present in work space 11; in the present example, there are three devices 14 (hereinafter referred to as devices A, B and C respectively) each with different functionality but each provided with the same announcement subsystem 15 for facilitating a device inventory by the user 10.

The announcement subsystem 15 is shown in greater detail for device B. The announce subsystem comprises:

a loudspeaker 20 for outputting a sound announcement indicating the existence of the device and its functionality, the generation of this output being effected by announce block 26 that feeds the loudspeaker;

a microphone 21 for listening to sounds emitted in the work space by the user and the devices;

analysis functional blocks 22 to 24 connected to receive the output of microphone 21, these blocks being a prompt detection block 22 for detecting a predetermined audio prompt such as a handclap, a quiet detection block 23 for detecting when no other device is making an announcement, and a collision detecting block for detecting when both the device itself and another device are simultaneously announcing (for which purpose, block 24 receives an input, not shown, from announce block 26 when the latter is outputting an announcement); and an announce control block 25 fed with the output of the analysis functional blocks 22 to 24 and implementing a collision-detection and backoff protocol on the basis of these outputs for controlling the generation and output of an announcement by the announce block 26 and loudspeaker 20.

The announce subsystem listens to sounds in the space 11. Upon user 10 making the predetermined audio prompt sound (e.g. a handclap), the announce control 25 is put into an active state by the output from the prompt detection block 22. The announce control now determines from the output of quiet detection block 23 when no other device is announcing and then enables the announce block 26 to make an announcement to inform the user about the device. If a collision is detected as indicated by output from block 24, the announce control stops the announcement by announce block 26 and backs off, that is, does not consider re-transmitting for a random time period. When the time period expires, the announce control waits for a quite period before enabling the announce block 26 again.

By having all devices control their announcements in this manner, in due course all the devices will make their announcements without interruption from the other devices.

The device announcement itself can comprise an initial element intended to facilitate collision detection and a main element for conveying device information to the user. The initial element can be a simple tone of predetermined frequency or a random pattern of predetermined tones, this latter having the advantage that there is a high probability, regardless of how many devices try to announce together, that over the period of the initial element transmitted by a first device, there will be a tone being generated by one or more of the other devices that does not conflict with the current tone being generated by the other device so that it is easy for the collision detection block to ascertain that the incoming sound contains sound from another device. As regards the main element of the announcement, this can be a musical signature or a verbal message. The announcement as a whole should not, of course, include pauses of a duration sufficient for another device to consider the announcement as having terminated.

In order to facilitate the task of the collision detection circuitry, not only is it informed by block 26 when it is generating its announcement, but it is also provided with a cancellation signal from the block 26 that corresponds to the announcement as it is made and is used by block 26 to cancel out that part of the signal from the microphone 21 that corresponds to the device' own announcement.

Preferably, the announce subsystem includes a further analysis functional block that can count each completed announcement by the other devices (that is, an announcement that starts, continues uninterrupted, and finishes with a quiet period). This enables the announce control to determine its position in the order of announcements following a user prompt and then, at the next prompt, seek only to announce when its turn is reached in the previously-established order of announcement; the device first in order will, of course, initiate its announcement without delay. The collision detection and backoff protocol is still operated for when the device is making its announcement. Furthermore, since a device may be removed from the space 11, if the device which is next in turn to announce does not, within a certain time, hear the expected announcement from whatever device should be announcing, the device assumes that the device one higher in the order has been removed and therefore it commences its own announcement; the device also advances its remembered position in the announcement order, this new position taking effect at the next prompt.

Many other variants are, of course, possible to the arrangement described above. For example, the devices could operate the collision detection and backoff protocol, not on the announcements themselves, but on non-sound emissions from the devices. These emissions are, for example, radio emissions, infrared emissions, or even data packets sent between the devices over a LAN to which all devices are connected. The emissions can be sent simultaneously with the sound announcements or in advance in order to predetermine an order for transmission of the sound announcements. In this latter case, the emissions can be triggered independently of the user prompt (for example, each device could be arranged to trigger, at intervals, an emission sequence by sending a first emission, thereby claiming first position in the order of transmission, with the other devices then sending their own emissions to compete for minor places in the order, the transmission order being reset each time this process is triggered by any device).

It is also possible to arrange for the devices to determine their order of announcement by means not involving a collision-detection and backoff protocol. For example, the devices can communicate with each other over non-sound short-range wireless links to establish an order for making the sound announcements, each device other than the first device in the established order, then listening to the sound announcements to determine when it is their turn to announce. Negotiation of the order of announcement can be done, for example, based on a unique number associated with each device such as a number specifically assigned for this purpose or the IP address of the device if the devices are networked devices, or by having each device generate a random number which is sent to all other devices (each device uses the received numbers to determine its position in the order and if there are two numbers the same, either the two conflicting devices exchange new random numbers between themselves or all devices recommence the process).

The devices themselves can serve any function and, indeed, a device may have no function beyond serving as an announcement device for a related entity.

What is claimed is:

1. A method of effecting an inventory of local devices, comprising:

(a) issuing a prompt to the devices;

(b) at each device, responding to the prompt by announcing the presence of the device by sound;

(c) the devices interacting to order their announcements so that each device announcement is, at least in due course, made uninterrupted by announcements from other devices.

2. A method according to claim 1, wherein step (c) includes the devices using a collision-detection and back-off protocol in respect of emissions from each other, this protocol including each device carrying out the following steps:

listening for the absence of emissions from other devices;

commencing transmission of its own emissions when a said absence is detected;

listening for a collision between its own emissions and those of another device;

where a collision is detected, backing off and deferring re-transmission for at least a period of time.

3. A method according to claim 2, wherein said emissions are the sound announcements made by the devices.

4. A method according to claim 3, wherein each said announcement comprises an initial element adapted to facilitate collision detection and a main element for conveying information regarding the device to a human listener.

5. A method according to claim 2, wherein the emissions are non-sound emissions made simultaneously with the sound announcements.

6. A method according to claim 2, wherein the emissions are non-sound missions made by each device in advance of its sound announcement in order to establish whether the device can safely make its sound announcement.

7. A method according to claim 1, wherein step (c) includes communication between the devices over non-sound short-range wireless links to establish an order for making the sound announcements, each device other than the first device in the established order, then listening to the sound announcements to determine when it is its turn to announce.

8. A method according to claim 1, wherein the sound announcement of each device announces the presence of the device to a human listener using a verbal or musical signature.

9. A method according to claim 1, wherein said prompt is a sound made by a human.

10. A method according to claim 8, wherein the prompt is a handclap.

11. The method of claim 1 wherein step (c) is performed by a plurality of the devices interacting with each other.

12. A device provided with an announcement arrangement comprising prompt detection means for detecting a broadcast prompt;

audio output means for announcing the presence of the device by sound; and announcement control means for interacting with nearby devices having similar announcement arrangements such that, at least in due course, each device makes its announcement, through its audio output means, uninterrupted by announcements from others of the said devices.

13. A device according to claim 12, wherein the control means is operative to implement a collision-detection and back-off protocol in respect of emissions from itself and the other devices, the control means comprising:

first detection means for detecting an absence of emissions from other devices;

transmission means for commencing transmission of its own emissions in response to a said absence being detected;

second detection means for detecting a collision between its own emissions and those of another device;

back-off means responsive to detection of a collision, to back off and inhibit a re-transmission by the transmission means for at least a period of time.

14. A device according to claim 13, wherein said emissions are the sound announcements made by the devices, the transmission means being formed by the audio output means and the detection means being audio detection means.

15. A device according to claim 14, wherein the audio output means is operative to output said announcement with an initial element adapted to facilitate collision detection and a main element for conveying information regarding the device to a human listener.

16. A device according to claim 13, wherein the emissions are non-sound emissions, the transmission means and detection means being adapted to handle such non-sound transmissions, and the transmission means being operative to transmit said emissions simultaneously with the audio output means making its sound announcement.

17. A device according to claim 13, wherein the emissions are non-sound emissions, the transmission means and detection means being adapted to handle such non-sound transmissions, and the transmission means being operative to transmit said emissions in advance of the audio output means making its sound announcement whereby to establish whether the device can safely make its sound announcement without colliding with an announcement from another of said devices.

18. A device according to claim 12, wherein the control means includes non-sound short-range wireless communication means, said interaction including communication between the devices using the non-sound short-range wireless communication means to establish an order for making the sound announcements, the control means being operative, except when it is first in the established order, to listen to the sound announcements of other devices in order to determine when to initiate an announcement through the audio output means of the device.

19. A device according to claim 12, wherein the audio output means is operative to announce the presence of the device to a human listener using a verbal or musical signature.

20. A device according to claim 19, wherein the prompt is a handclap.

21. A device according to claim 12, wherein the prompt detection means is operative to detect a prompt in the form of a sound made by a human.

22. A device provided with an announcement arrangement comprising a prompt detector for detecting a broadcast prompt;

an aural source for announcing the presence of the device; and a controller for interacting with nearby devices having similar announcement arrangements such that, at least in due course, each device is arranged to make its announcement, through its aural source, uninterrupted by announcements from other of the said devices.

23. A device according to claim 22, wherein the controller is operative to implement a collision-detection and back-off protocol in respect of emissions from itself and the other devices, the controller being arranged for (a) detecting an absence of emissions from other devices, (b) commencing transmission of its own emissions in response to detection of a said absence, (c) detecting a collision between its own emissions and those of another device, (d) backing off and inhibiting a re-transmission by the aural source for at least a period of time in response to detection of a collision.

24. A device according to claim 23, wherein said emissions are the aural announcements arranged to be made by the devices, the aural source being arranged to provide the transmission, and an audio detector for providing the detection.

25. A device according to claim 24, wherein the aural source is operative to output said announcement so said announcement is adapted to include an initial element for facilitating collision detection and a main element for conveying to a human listener information regarding the device.

26. A device according to claim 23, wherein the emissions are non-aural emissions, and the controller is arranged for causing (a) the transmission and detecting to be of such non-aural transmissions, and (b) said emissions to be transmitted simultaneously with the aural source making its aural announcement.

27. A device according to claim 23, wherein the emissions are non-aural emissions, and the controller is arranged for causing (a) the transmission and detecting to be of such non-aural transmissions, and (b) said emissions to be transmitted in advance of the aural source making its aural announcement whereby to establish whether the device can safely make its aural announcement without colliding with an announcement from another of said devices.

28. A device according to claim 22, wherein the controller includes non-aural short-range wireless communication network, said interaction including communication between the devices using the non-aural short-range wireless communication network to establish an order for making the sound announcements, the controller being operative, except when it is first in the established order, to listen to the aural announcements of other devices in order to determine when to initiate an announcement through the aural source of the device.

29. A network including a plurality of the devices of claim 22.

* * * * *